US008215048B2

(12) United States Patent
Summers

(10) Patent No.: US 8,215,048 B2
(45) Date of Patent: Jul. 10, 2012

(54) WEAPON CONTROL DEVICE

(76) Inventor: James Summers, Tempe, AZ (US)

( * ) Notice: Subject to any disclaimer, the term of this patent is extended or adjusted under 35 U.S.C. 154(b) by 234 days.

(21) Appl. No.: 12/417,319

(22) Filed: Apr. 2, 2009

(65) Prior Publication Data

US 2009/0255160 A1 Oct. 15, 2009

Related U.S. Application Data

(60) Provisional application No. 61/044,368, filed on Apr. 11, 2008.

(51) Int. Cl.
*F41A 19/00* (2006.01)

(52) U.S. Cl. ..... 42/85; 42/70.06; 42/84

(58) Field of Classification Search ..... 42/84, 85, 42/70.01, 70.06, 70.11
See application file for complete search history.

(56) References Cited

U.S. PATENT DOCUMENTS

| | | | | |
|---|---|---|---|---|
| 2,134,406 | A | 10/1938 | Jacobs | |
| 4,476,644 | A | 10/1984 | Laing | |
| 4,488,369 | A | 12/1984 | Van Note | |
| 4,719,713 | A | 1/1988 | Hagle | |
| 4,739,569 | A | 4/1988 | Battle | |
| 4,829,692 | A * | 5/1989 | Guild | 42/1.01 |
| 5,016,378 | A | 5/1991 | Sain | |
| 5,213,913 | A * | 5/1993 | Anthony et al. | 429/97 |
| 5,448,847 | A * | 9/1995 | Teetzel | 42/70.11 |
| 5,461,812 | A | 10/1995 | Bennett | |
| 5,715,623 | A | 2/1998 | Mackey, III | |
| 5,896,691 | A * | 4/1999 | Kaminski et al. | 42/70.11 |
| 6,223,460 | B1 | 5/2001 | Schmitter et al. | |
| 6,286,242 | B1 | 9/2001 | Klebes | |
| 6,305,941 | B1 | 10/2001 | Kotsiopoulos et al. | |
| 6,321,478 | B1 | 11/2001 | Klebes | |
| 6,412,207 | B1 | 7/2002 | Crye et al. | |
| 6,415,542 | B1 | 7/2002 | Bates et al. | |
| 6,442,880 | B1 | 9/2002 | Allan | |
| 6,477,801 | B1 * | 11/2002 | O'dwyer | 42/70.11 |
| 6,510,642 | B2 | 1/2003 | Riener | |
| RE38,794 | E | 9/2005 | Danner | |
| 6,976,416 | B2 * | 12/2005 | Ealovega | 89/141 |
| 7,168,198 | B2 | 1/2007 | Newkirk et al. | |
| 2002/0144447 | A1 | 10/2002 | Hathaway | |
| 2003/0136042 | A1 | 7/2003 | Albanesi et al. | |
| 2004/0244253 | A1 | 12/2004 | Glock | |
| 2006/0117634 | A1 | 6/2006 | Vor Keller et al. | |
| 2006/0288626 | A1 | 12/2006 | Kim | |
| 2007/0074438 | A1 | 4/2007 | Parhofer et al. | |

* cited by examiner

*Primary Examiner* — Gabriel Klein

(74) *Attorney, Agent, or Firm* — Schmeiser, Olsen & Watts LLP

(57) ABSTRACT

A weapon control device is provided and is coupled within a weapon for controlling accessories and auxiliary components. The weapon control device includes a processor and a connector operably engaging a selector switch of a weapon. The processor receives a signal from the connector in response to movement of the selector switch. The weapon control device further includes one of a transmitter and a transceiver, wherein one of the transmitter and transceiver send a signal in response to the processor receiving a signal from the connector. The weapon control device further includes a weapon accessory, wherein the weapon accessory is activated in response to the signal sent by one of the transmitter and transceiver.

15 Claims, 8 Drawing Sheets

WEAPON CONTROL DEVICE

CROSS REFERENCE TO RELATED APPLICATION

This application claims priority to U.S. Provisional Patent Application entitled "MULTIPURPOSE WEAPON SELECTOR SWITCH," Ser. No. 61/044,368, filed Apr. 11, 2007, the disclosure of which is hereby incorporated entirely herein by reference.

BACKGROUND OF THE INVENTION

1. Technical Field

This invention relates generally to a weapon control device and more particularly to weapon control device coupled within a pistol grip of a weapon for controlling accessories and auxiliary components.

2. State of the Art

There are many different types of weapons and particularly many different types of guns that may be used by both military and civilians. Guns typically all have one common feature—a selector switch. A selector switch is utilized to move the gun from one firing state to another, for example the selector switch may move a gun between the states of safe, fire, auto, and burst. This provides a safer weapon when not in use and allows the operator to actively change the status of the gun.

Conventional selector switches basically allow the operator to move the gun from one status to another during use of the weapon. The switch is very limited in its purpose and uses. Other conventional systems have sought to improve upon this selector switch and include a type of electronic communication with the selector switch in order to provide additional safety of use of the weapon.

These electronic conventional selector switches provide for the transmitting and receiving of certain signals that allows the operator to activate the weapon. For example the conventional systems include a receiver that receives a signal transmitted from another device worn or carried by the operator. When the device transmitting the signal is within a particular distance from the weapon, the weapon may then allow for the movement of the selector switch from a safe status to another status. This prevents a different operator from being able to use the weapon and is particularly useful in preventing a child from using the weapon. While these conventional electronic selector switches do provide certain benefits, they have their drawbacks.

These drawbacks include the inability to communicate the current status of the gun and to store that status for additional use. Conventional electronic selector switches also lack the ability to control other electric attachments that may be present on the weapon in response to the change of status of the weapon and to actively communicate to the operator and or supervisor the current status and operation of the weapon.

Further, the conventional selector switches do not provide a weapon control device that is capable of sending signals to activate accessories and auxiliary components.

Accordingly, there is a need in the field of weapon control devices for an improved weapon control device coupled within a grip of a weapon for controlling accessories and auxiliary components.

DISCLOSURE OF THE INVENTION

The present invention relates to weapon control device coupled within a grip of a weapon for controlling accessories and auxiliary components. The weapon control device creates, stores, receives, and transmits information in response to an electronic signal from a series of military and civilian weapons that were not originally designed to do so. The device is housed in such a way to achieve the mechanical abilities of the original selector switch in addition to sending a signal to communicate to a processor and/or a transmitter or other similar electronic devices the weapons status of safe, fire, auto, and burst. The device may then utilize the stored information based on the signal generated and stored for the use of activating any accessory, attachment, or remote electronic hardware linked to the weapon or within the transmission range of the device.

An aspect of the present invention includes a weapon control device coupled within a weapon for controlling accessories and auxiliary components. The weapon control device includes a processor and a connector mechanically engaging a selector switch of a weapon. The processor receives a signal from the connector in response to movement of the selector switch. The weapon control device further includes one of a transmitter and a transceiver, wherein one of the transmitter and transceiver send a signal in response to the processor receiving a signal from the biased connector.

Another aspect of the present invention includes a weapon control device coupled within a pistol grip of a weapon for controlling accessories and auxiliary components. The weapon control device includes a removable housing repeatably removable from within a pistol grip of a weapon. The housing retains a processor, at least one connection point electrically coupled to the processor, and a slideable biased securing device. The securing device releasably secures to the housing within the pistol grip in response to the securing device biased to engage a recess of the pistol grip. The weapon control device further includes a connector mechanically engaging a selector switch of a weapon and electrically engaging the at least one connection point when the housing is secured within the pistol grip. The processor receives a signal from the connector in response to movement of the selector switch. The weapon control device further includes one of a transmitter and a transceiver, wherein one of the transmitter and transceiver send a signal in response to the processor receiving a signal from the connector.

Yet another aspect of the present invention includes a method of using a weapon control device. The method comprises moving the selector switch from one state to another; generating a first signal in response to the movement of the selector switch; processing the first signal; transmitting a second signal to an accessory; and activating the accessory in response to the transmitted second signal.

Another aspect of the present invention includes a weapon firing system comprising a weapon having a weapon control device and a laser sight. The firing system further includes a predetermined area, wherein the weapon may be activated and able to fire in response to a communication received by a transceiver integral with the weapon control device. The weapon control device disables the weapon in response to movement of the laser outside of the predetermined area.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a weapon control device that creates and stores, and uses information in response to an electronic signal from a series of military and civilian weapons that were not originally designed to do so by replacing the selector switch portion of the particular weapons. The device is housed in such a way to achieve the mechanical abilities of the original selector switch in addition to sending a signal to communicate to a CPU and/or a transmitter or other similar electronic devices the weapons status of safe, fire, auto, and burst. The device may then utilize the stored information based on the signal generated and stored for the use of activating any accessory or attachment linked to the weapon.

Figure 1:
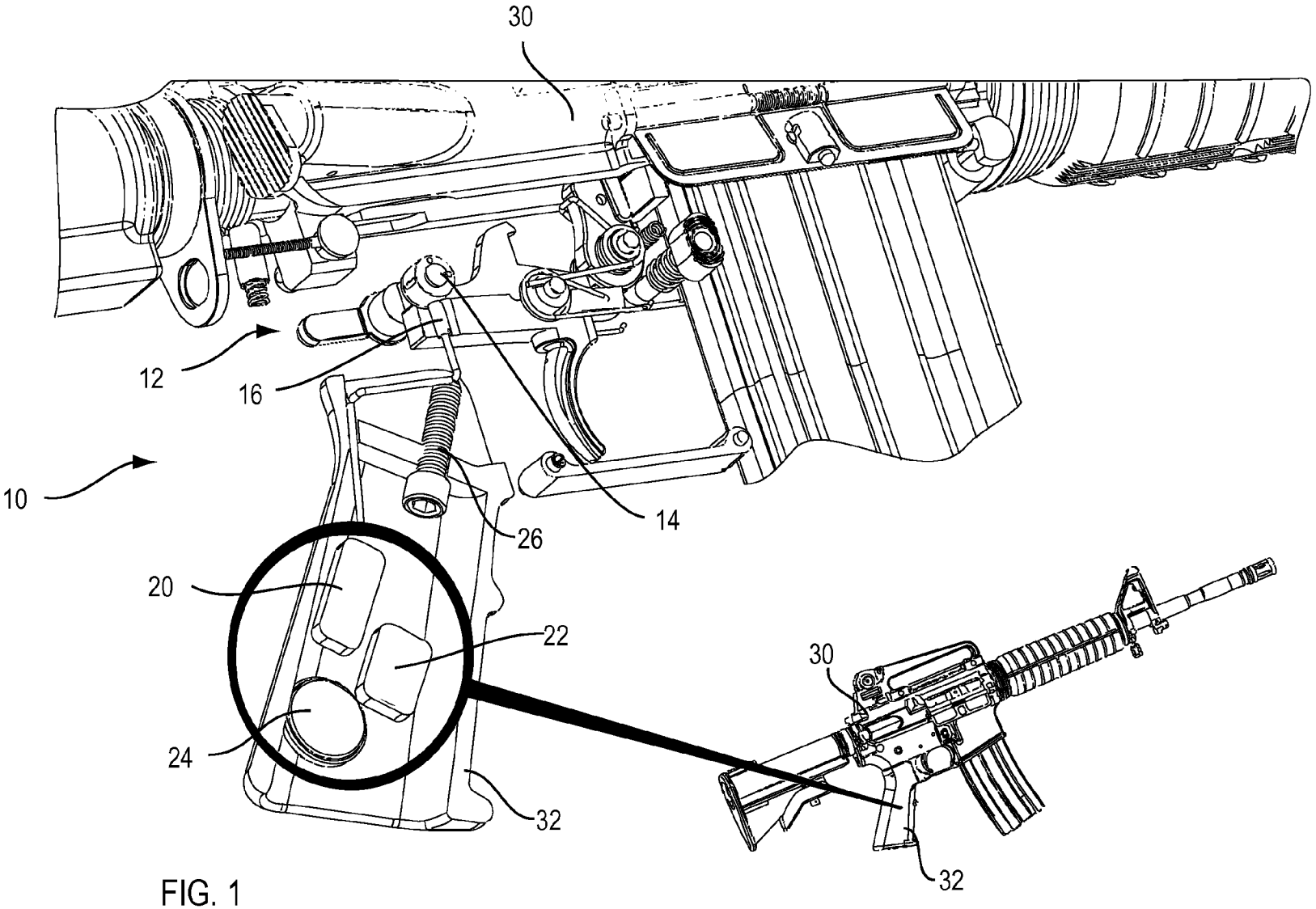
FIG. 1 is a perspective view of a weapon with a weapon control device couple thereto in accordance with the present invention.
Figure 2A:
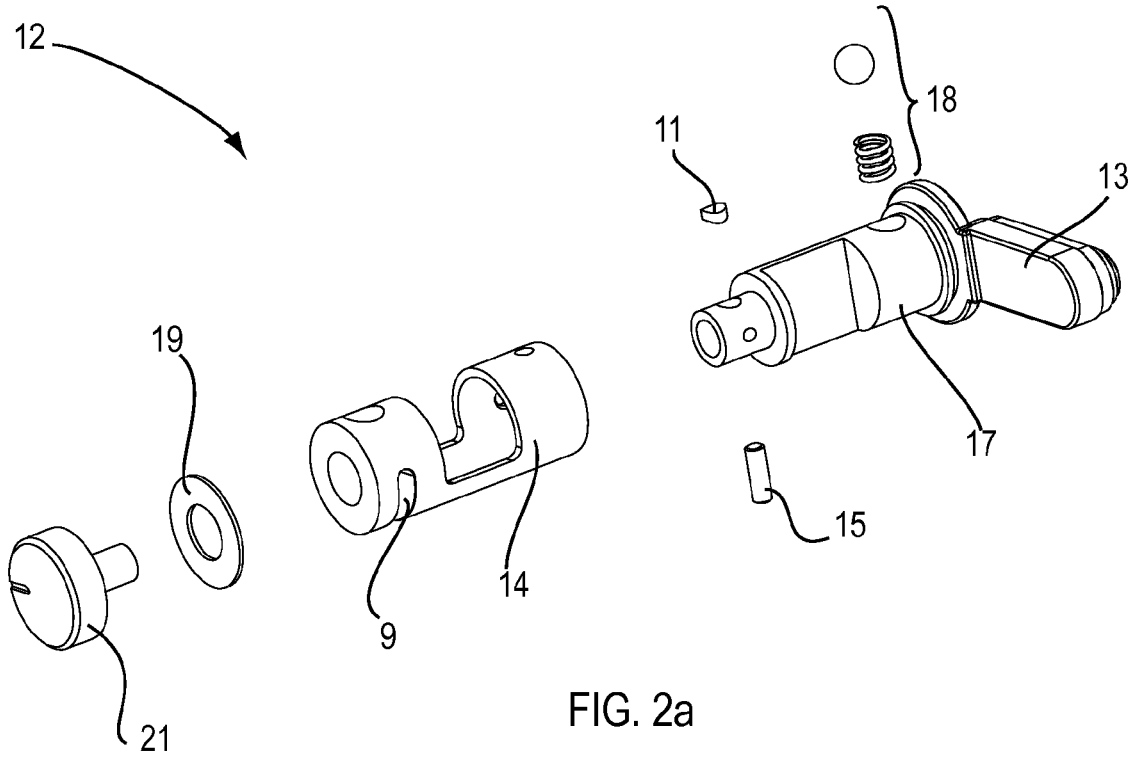
FIGS. 2*a* and 2*b* are a perspective exploded view of a modified selector switch and a perspective view of the modified selector switch of respectively.
Figure 2B:
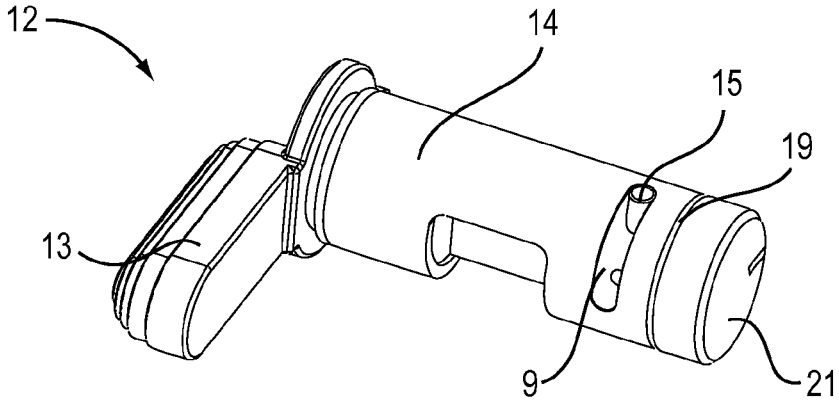
Figure 3:
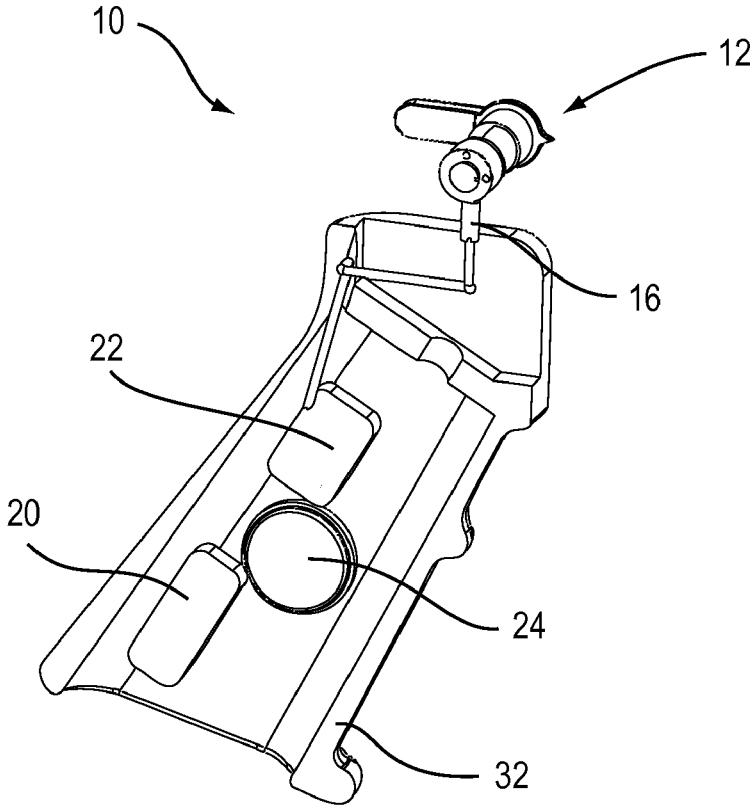
FIG. 3 is a perspective diagrammatic view of a weapon control device and additional components in accordance with the present invention.

Referring to the drawings, FIGS. 1-3 depict a weapon control device 10 according to particular embodiments of the present invention. The weapon control device 10 may include a selector switch 12 having a selector switch face component 13, a communication receiver 14, and a communication device 16. The selector switch face component 13 is operative coupled to the communication receiver 14, wherein the communication receiver 14 is coupled over a mechanical interface drum 17. The detent ball and spring 18 may be coupled to the communication receiver 14. The detent ball and spring 18 operates to locate and retain the selector switch 12 in the desired orientation with regard to fire control. The communication device 16 may be operatively coupled to the communication receiver 14. The communication device 16 may be adapted to generate a signal in response to movement of the communication receiver 14 from one weapon status to another. It will be understood that the signal may vary depending on the status and may communicate information regarding the particular status of the weapon 30.

The selector switch may also include a conductivity interrupter 11, an over travel pin 15, a washer or gasket 19 and a selector indicator face 21. The conductivity interrupt interrupts the conductivity of the connector 16 when the selector switch 12 is in the safe status. The over travel pin limits the range of rotation of the selector switch 12. The selector face 21 and washer 19 are coupled to the selector switch components. The selector face 21 provides a visual indication of the status of the selector switch 12. As seen in FIG. 2B, the over travel pin 15 is engaged within channel 9, wherein the channel 9 is a length that controls the distance the selector switch 12 may rotate. The selector switch 12 stops rotation when the over travel pin 15 contacts either end of the channel 9.

It will be understood that the connector 16 replaces the original selector detent and allows communication of the switch status to pass though the weapon receiver and into the modified pistol grip 32 containing the transmitter and battery portion of the device. It will further be understood that while this particular embodiment depicts a modified pistol grip 32, an electronics mount or container may be utilized. The mount may be used to contain the transmitter and wiring, power supply, CPU and any other features or equipment. The electronics mount and its contents could be fastened or bolted to the gun through the use of the weapon's 30 pistol grip screw 26.

The modified selector switch can serve a second use in that it may be used to locate and or retain the mechanical or electrical components and or the entire replacement selector switch assembly inside of the weapon in which the device is installed. The communications device structure allows a passage through the selector detent section of an M16, AR15, or any other weapon or similar weapon receiver through which communication between the selector and additional electronics or mechanics can be made.

Some embodiments may utilize a modified pistol grip screw 26 to allow communications or additional features to be added. By drilling a hole or creating a passage through the center line of the bolt or fastener. Wires, fiber optics, or other means of communication may be passed through without modification to a weapons receiver. This could be developed further into a replacement component that may replace the pistol grip screw 26 with an assembly upon which the inventions transmission, power, and memory hardware may be installed, secured or stored.

It will also be understood that the selector switch location housing 14 replaces the weapons original selector switch and is part of an assembly of two or more pieces, such as a detent ball and spring 18. Inside of the location housing 14, the activated rate of fire or selected position of the selector switch may complete or interrupt a connection electronically as well as mechanically. The selector switch location housing 14 may also serve a second use to retain and or locate or orient other parts in the weapon control device 10 or within the weapon 30 in which it is installed.

It will further be understood that the selector switch face component 12 works with the selector switch location housing 14 to complete a connection of communications or signal whether it be through mechanical, electronic or any other means of communicating activation of a device. The face component 12 can resemble a similar interface and geometry to the weapons original shape on the part that is seen from the outside of the rifle. The selector switch face component 12 engages and disengages the mechanical safety switch of the weapon 30 as well as designates the rate of fire.

The weapon control device 10 may also include a CPU 22. The CPU 22 may comprise a processor and a memory. The processor may be adapted to process the signal generated by the communication device 16 and store information on the memory in response to the processed signal. The CPU 22 may then be utilized to activate accessories that may be attached to the weapon 30.

Figure 6:
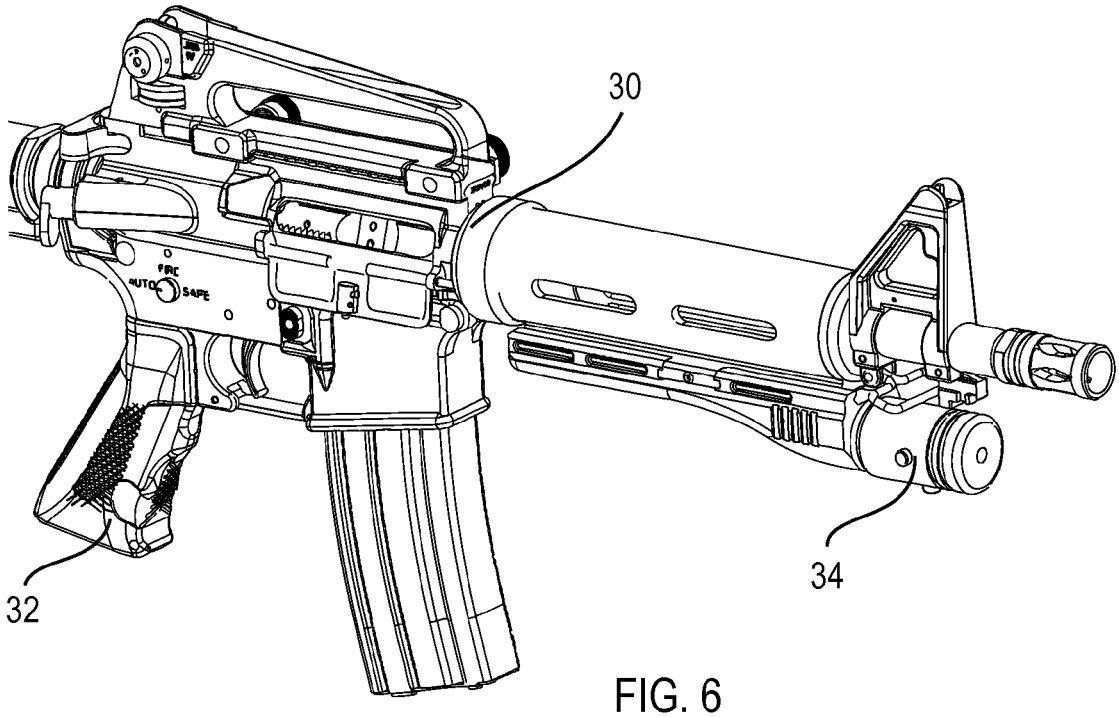
FIG. 6 is a perspective view of a weapon with a weapon control device and a weapon accessory.

Accessories of the weapon 30 may include any accessory 34 outfitted with a transceiver, as shown in FIG. 6. The signal generated by the weapon control device 10 may be used to turn on accessories such as, but not limited to flashlights, lasers, range finders, and electronic optics or electronics pre wired with receivers. The activation of the weapon control device 10 informs the accessory 34, such as wired electronics that it is time to activate.

While the weapon control device 10 may be utilized to turn on accessories, other uses are contemplated. For example and without limitation, the weapon control device may be used to link the weapon 30 with a household security system to inform authorities the weapon 30 is activated. Another example may include a camera coupled to the weapon 30, wherein the camera is activated in response to the weapon control device 10 and records everything that the weapon 30 is aimed at and/or shoots at. This is beneficial in instances such as, but not limited to, training and resolving a dispute as to whether deadly force was proper. Signals could be translated and transmitted into a format to communicate with computers, computer networks, the internet, or satellite transmissions which in turn may relay data from the switch to someone's mobile phone or similar electronics device.

The weapon control device 10 may further include a transmitter 20 and optional wiring. The transmitter 20 may be adapted to relay the captured signal or a new signal based on the stored information in the memory of the CPU 22 to transceivers located in accessories attached to the weapon and/or to accessories not attached to the weapon 30. Hard wiring could optionally run from the weapon control device 10 to connection points on the weapon 10, the connection points operating to activate or deactivate accessories attached thereto. It will be understood that the wiring may also be, without limitation, fiber optics or some other means of creating communication between the weapon control device 10 and the signal transmitter 20 and accessories. This is a simple solution to creating a non conductive circuit of communication that is not affected by electro magnetic interference.

It will further be understood that the transmitter 20 and CPU 22 may be adapted to transmit an encrypted signal. This is particularly pertinent on a battlefield where the signals of the weapon control device 10 could be jammed, blocked or otherwise corrupted by someone with an electronic device. Additionally, the signal sent by the weapon control device 10 may need to be authorized or otherwise secured.

The weapon control device 10 may further include a power supply 24. The power supply 24 would provide the necessary power to operate electronic components such as, but not limited to the CPU 22 and the transmitter 20. While shown in the drawing figures that the power supply 24 is a battery, it will be understood that the power supply 24 is not limited to a battery. Accordingly, the power supply 24 may also be, but is not limited to, solar panels or any component capable of producing the power requirements.

Figure 4A:
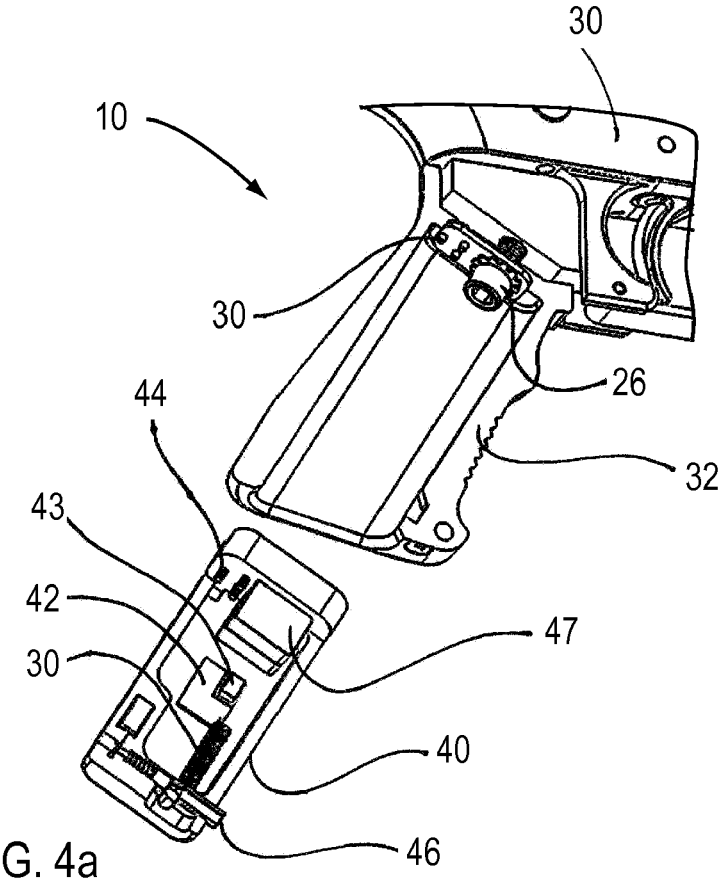
FIG. 4*a* is a perspective exploded view with a partial cutaway showing weapon with a weapon control device having a removable housing.
Figure 4B:
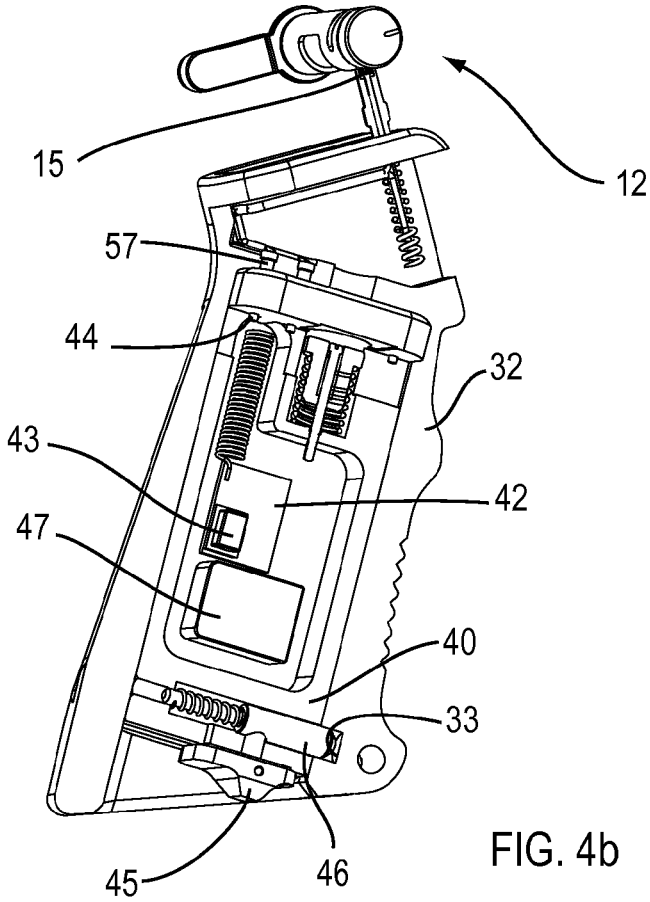
FIG. 4*b* is a perspective view with a partial cutaway showing the weapon with the weapon control device having a removable housing secured within the weapon.

Referring to the drawings, FIGS. 4-6 depict a weapon control device 40 according to particular embodiments of the present invention. The weapon control device 40 may include a selector switch 12 as shown in FIG. 2 having a selector switch face component 13, a selector switch location housing 14, and a connector 16. The selector switch face component 13 is operative coupled to the selector switch location housing 14. The detent ball and spring 18 is coupled between the face component 13 and the location housing 14. The detent ball and spring 18 operates to locate and retain the selector switch location housing 14 in the desired orientation with regard to fire control. The connector 16 is mechanically and operatively coupled to the location housing 14. The connector 16 generates a signal in response to movement of the location housing 14 of the selector switch 12 from one weapon status to another. It will be understood that the signal may vary depending on the status and may communicate information regarding the particular status of the weapon 30.

Figure 5A:
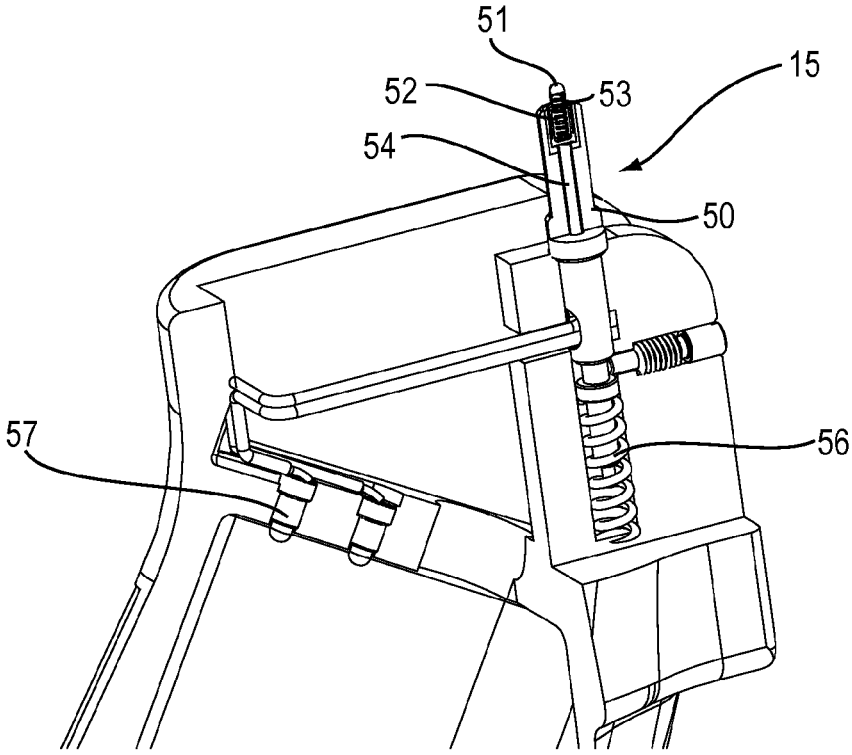
FIGS. 5*a* and 5*b* are perspective views of a connector of a weapon selector in accordance with embodiments of the present invention.
Figure 5B:
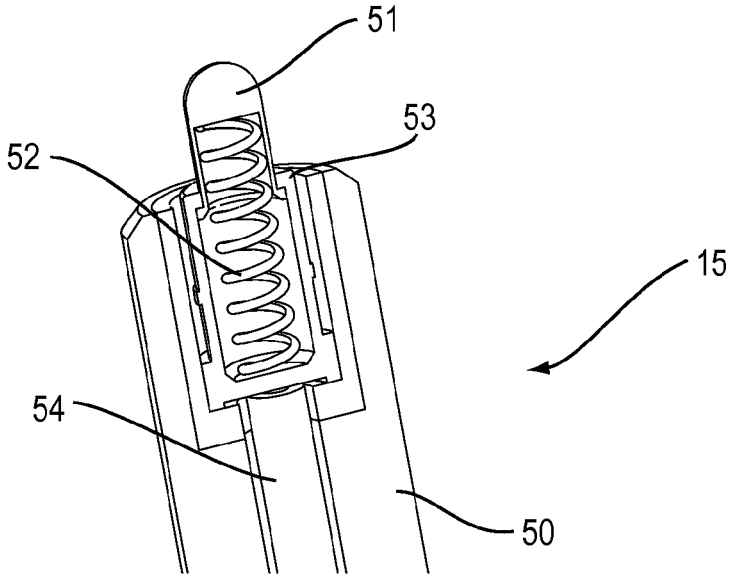

Referring further to FIGS. 5*a* and 5*b*, the connector 16 may include a biased connector having a biased co-axial connector 50 that is biased by co-axial spring 56; a connector tip 51 biased by tip spring 52 and wire 54 electrically coupled on one end to connector tip 51 and coupled on the other end to an electrical connector 57 for electrically connecting the biased connector 15 to the connectivity points 44 of the weapon control device, which is electrically connected to the processor 42.

Because the connector 16 is biased, the connector tip 51 engages the communication receiver 14 of the selector switch 12 wherein, the communication receiver 14 has discrete points of connectivity or connectivity interrupters 11 and the tip 51 engage as the selector switch 12 is rotated between weapon statuses. For example, when the selector switch 12 is in safe status, the connector tip 51 is not in contact with a point of connectivity. When the selector switch is rotated to the fire status, the connector tip 51 engages a connectivity point associated with the fire status and the circuit is completed, allowing the processor to receive a particular signal controlled by the electronic components such as resistors, transistors and the like. In particular embodiments, the communication receiver 14 may include channel 80 with adjacent communication surface 81. The connector tip 51 may be engaged within the channel 80, while the co-axial connector 50 engages the surface 81. In this configuration, the connector tip 51 may engage a connectivity interrupter 11 while the co-axial connector 50 engages the surface of the communication receiver 14, the co-axial connector acting as a ground. A signal is then sent to the processor 42 via wire 54. In these embodiments, there may also be present, a second wire 53, wherein the second wire 53 operates as a ground for the weapon control device 40. In particular embodiments, multiple connectivity interrupters 11 are included, each connectivity interrupter 11 associated with a different status of the weapon and each connectivity interrupter 11 allowing a different signal to be transmitted that corresponds to the different weapon status.

It will be understood that other connectors 16 may be used, such as, but not limited a fiber optic connector. These other connectors 16 are operational so long as they are resistant to electromagnetic interruption.

The weapon control device 40 further includes a removable housing 41 repeatably removable from within the pistol grip 32 of the weapon 30. The housing 41 retains a processor 42 and at least one connection point 44 electrically coupled to the processor 42. The housing 41 also retains a slideable biased securing device 46. The securing device 46 releasably secures to the housing 41 within the pistol grip 32 in response to the securing device 46 biased to engage a recess 33 of the pistol grip 32. In particular embodiments, the securing device may further include a switch 45. The securing device 46 slides in response to sliding the switch 45. Further, the weapon control device may further comprise a spring 48, wherein the spring 48 ejects the housing 41 in response to the disengaging the securing device 46.

The biased connector 15 mechanically engages the selector switch 12 of a weapon and electrically engages the at least one connection point 44 by use of wire 54 when the housing 41 is secured within the pistol grip 32. In this configuration, the processor 42 receives a signal from the biased connector 15 in response to movement of the selector switch 12.

The housing 41 further retains one of a transmitter and a transceiver 43, wherein one of the transmitter and transceiver 43 send a signal in response to the processor 42 receiving a signal from the connector 15. In particular embodiments, as seen in FIG. 6, a weapon accessory 34 may be coupled to a weapon 30. The weapon accessory 34 is activated in response to the signal sent by one of the transmitter and transceiver 43. Further, the transceiver 43 may be placed into a listening status in response to the processor 42 receiving a signal from the biased connector 15. It will be understood that particular embodiments of the present invention include a communication device 40 having a housing 41 that retains a plurality of transmitters, transceivers and combinations thereof.

According to particular embodiments of the present invention, the selector switch 12 is moveable between multiple weapon statuses, the multiple weapon statuses including at least safe status, fire status, auto status, and burst status. In these particular embodiments, the signal received by the processor 42 is sent by the biased connector 15 in response to the selector switch moving from one status to another status. The signal sent by the biased connector 15 is different for each status of the weapon.

In other embodiments, the weapon control device 40 may further comprise a memory integral with the processor 42 for storing information relating to predetermined accessories and auxiliary components. The stored information corresponds to a type of signal received by the processor 42. The type of signal sent by one of the transmitter and the transceiver 43 is determined in response to the type of signal received by the processor 42, the type of signal corresponding to the stored information in the memory. Accordingly, a weapon accessory and/or auxiliary component corresponding to the stored information in the memory is activated in response to the signal sent by one of the transmitter and transceiver 43.

Accessories of the weapon 30 may include any accessory 34 outfitted with a transceiver, as shown in FIG. 6. The signal generated by the weapon control device 10 internal to the pistol grip 32 may be used to turn on accessories such as, but not limited to flashlights, lasers, range finders, and electronic optics or electronics pre wired with receivers. In FIG. 6, the accessory 34 is a laser sight. The activation of the weapon control device 40 informs the accessory 34, such as wired electronics that it is time to activate.

While the weapon control device 40 may be utilized to turn on accessories, other uses are contemplated. For example and without limitation, the weapon control device may be used to link the weapon 30 with a household security system to inform authorities the weapon 30 is activated. Another example may include a camera coupled to the weapon 30, wherein the camera is activated in response to the weapon control device 10 and records or relays video of everything that the weapon 30 is aimed at and/or shoots at. This is beneficial in instances such as, but not limited to, training and resolving a dispute as to whether deadly force was proper. Signals could be translated and transmitted into a format to communicate with computers, computer networks, the internet, or satellite transmissions which in turn may relay data from the switch to someone's mobile phone or similar electronics device.

The weapon control device 40 may further include one of a transmitter and transceiver 43 and optional wiring. The one of a transmitter and transceiver 43 may be adapted to relay the captured signal or a new signal based on the stored information in the memory to transceivers located in accessories attached to the weapon and/or to accessories not attached to the weapon 30. Hard wiring could optionally run from the weapon control device 40 to connection points on the weapon 30, the connection points operating to activate or deactivate accessories attached thereto. It will be understood that the wiring may also be, without limitation, fiber optics or some other means of creating communication between the weapon control device 40 and the one of a transmitter and transceiver 43 and accessories 34. This is a simple solution to creating a non-conductive circuit of communication that is not affected by electro magnetic interference.

It will further be understood that one of the transmitter and transceiver 43 may be adapted to transmit an encrypted signal. This is particularly pertinent on a battlefield where the signals of the weapon control device 40 could be jammed, blocked or otherwise corrupted by someone with an electronic device. Additionally, the signal sent by the weapon control device 40 may need to be authorized or otherwise secured.

The weapon control device 40 may further include a power supply 47. The power supply 47 would provide the necessary power to operate electronic components such as, but not limited to the processor 42 and one of the transmitter and transceiver 43. While shown in the drawing figures that the power supply 47 is a battery, it will be understood that the power supply 47 is not limited to a battery. Accordingly, the power supply 47 may also be, but is not limited to, solar panels or any component capable of producing the power requirements.

Figure 7A:
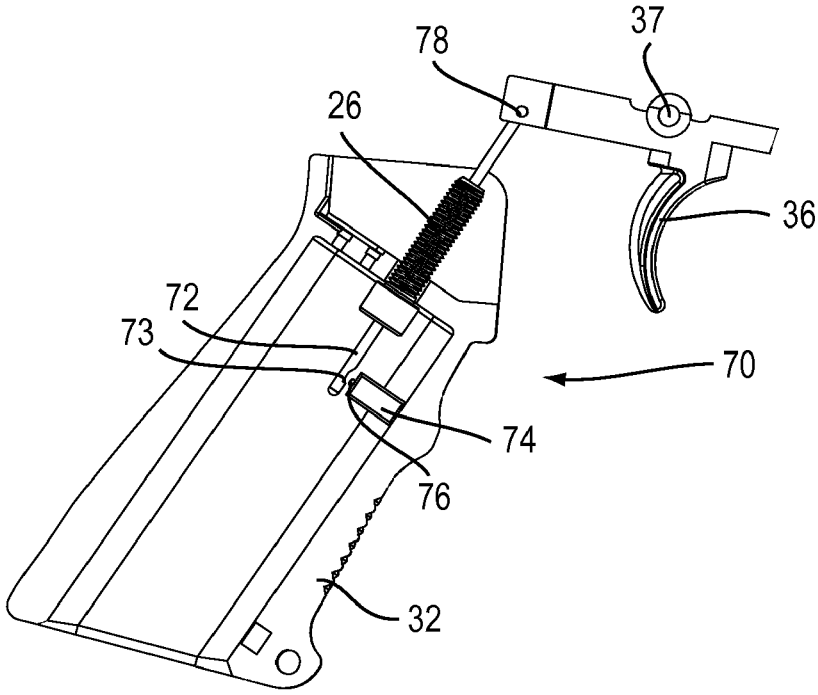
FIGS. 7*a* and 7*b* are perspective views of a disablement mechanism of a weapon control device in accordance with the present invention.
Figure 7B:
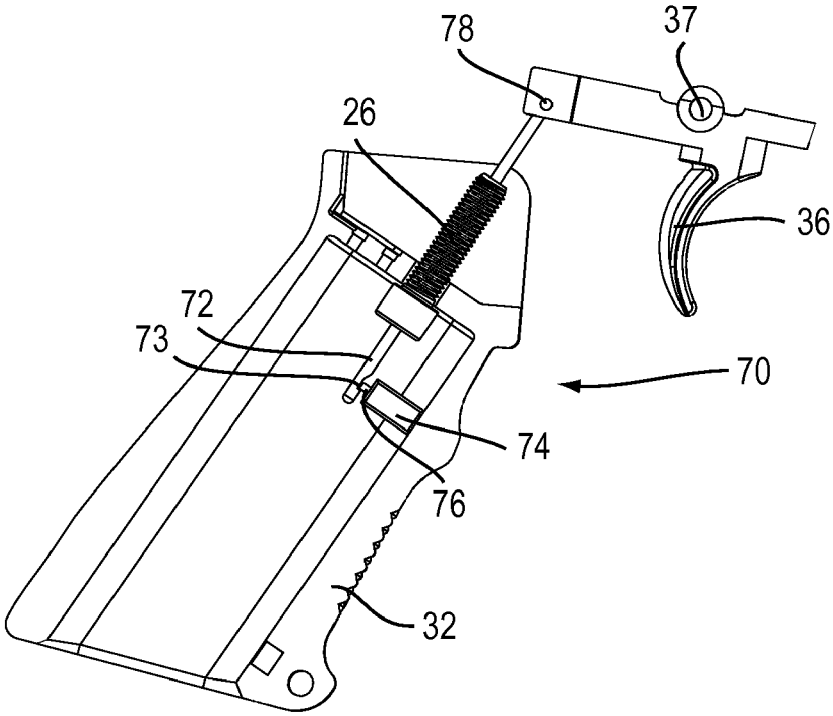

Referring again to the drawings, FIGS. 7*a* and 7*b* depict a disablement device 70 that is an optional component of the weapon control device 40. The disablement device 70 is coupled within the pistol grip 32 and includes a disablement shaft 72, an actuator 74 and an actuator arm. The disablement shaft 72 is coupled to a trigger 36 at point 78. The disablement shaft 72 extends through the pistol grip screw 26. The disablement shaft 72 includes a notch 73. The actuator arm 76 repeatably engages and disengages the notch in response to activation of the actuator 74. The trigger 36 is disabled in response to the actuator arm 76 engaging the notch 73 of the disablement shaft 72. When the actuator arm 76 engages the notch 73, the trigger 36 is unable to pivot about trigger pivot point 37, thereby rendering the weapon inoperable. The trigger 36 is enabled in response to the actuator arm 76 disengaging the notch 73. Then the actuator arm disengages the notch 73, the trigger 36 is free to rotate about the trigger pivot point 37, thereby rendering the weapon operable.

According to particular embodiments, the actuator 74 is activated in response to the transceiver 43 receiving an external signal. The processor 42 may be utilized to process the signal received by the transceiver 43 and control the actuator 74.

In other embodiments of the present invention, the disablement device 70 may be a manual lock. For example and without limitation, the disablement device 70 may be a manual key lock.

The weapon control device may, according to particular embodiments of the present invention, become a type of universal remote control, with the possibility of numerous selector orientations and connections for each orientation. The amount of signals generated corresponds to the number of orientations and further correspond to separate actions that may take place in response to movement of the weapon control device 10 into the various orientations. This embodiment of the present invention is only limited in number by the scale and size of the electronic components being used.

It will be understood by those of ordinary skill in the art that the failure of the present invention's electronic components in no way affects the mechanical functions of the weapon system. If electronic shorts occur, they will not prevent the movement and action of the mechanical pieces.

It will also be understood components of a weapon control device may be adapted to have protection from electro magnetic interference ("EMI"). EMI includes powerful waves of energy that can be used to destroy unprotected electronic components. This is particularly useful in military type settings where there is a need to consider the effects of EMI on the weapon control device 10.

In additional embodiments of the present invention, bypass switches may be mounted to the weapon, the bypass switches adapted to put the selector switch components in a powered down state so as to reduce the risk of an outside object manipulating the selector switch during transportation or storage. The weapon control device may also power down the transmitter and transceiver to conserve battery power when the weapon selector switch is moved to the safe position.

Additional embodiments of the present invention may include the weapon control device being formed as one single replacement selector switch wherein the power source, CPU or processor, and transmitter/transceiver are made in a small enough size so as to be contained in the size and shape of the original selector switch. This embodiment would require an orientation device that detects the orientation of the device in order to determine if the selector switch has moved from one firing state to another.

Figure 8:
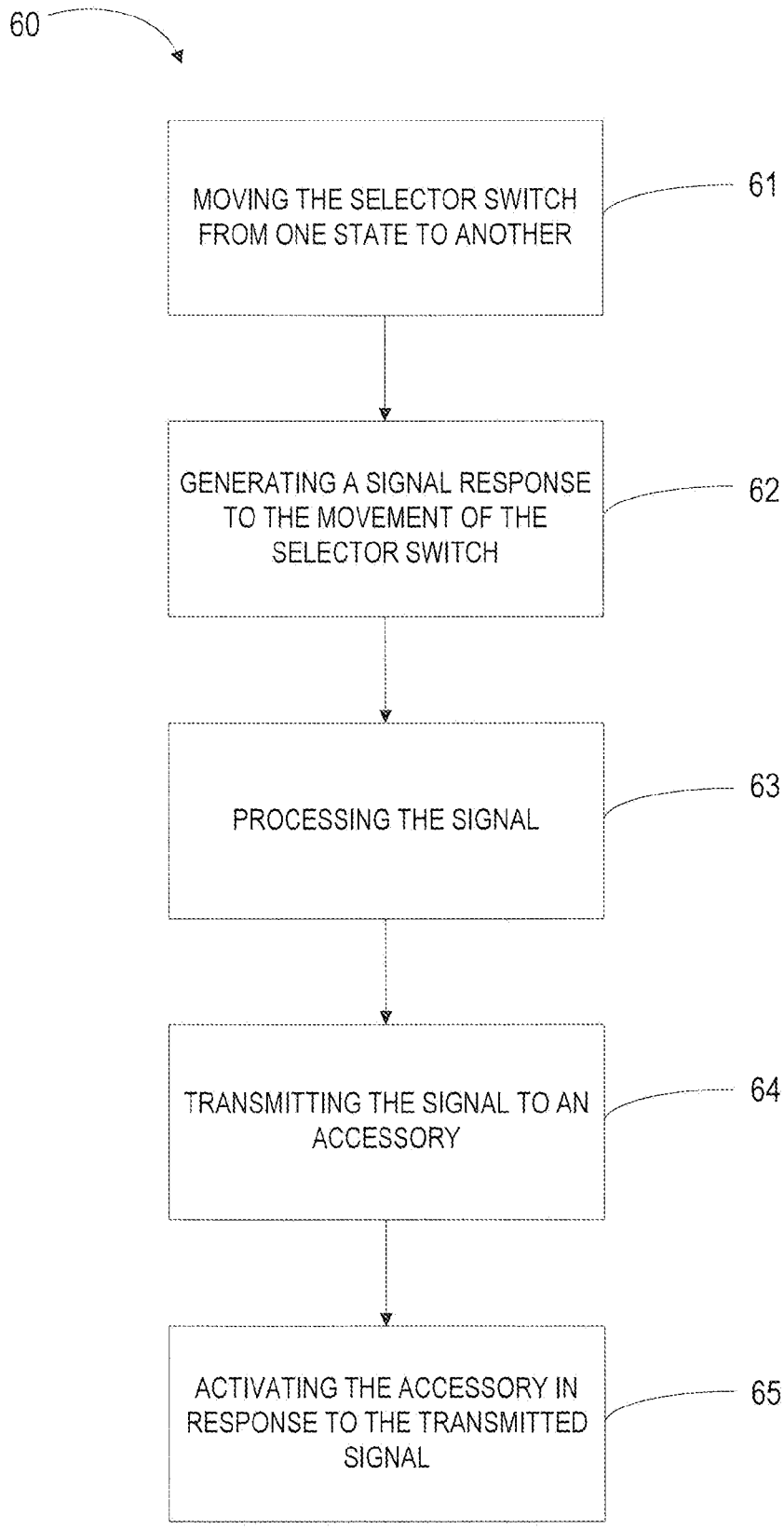
FIG. 8 is a flow chart of a method of using a weapon control device.

Referring further to the drawings, FIG. 8 depicts a method 60 of using a weapon control device in accordance with the present invention. The method 60 includes moving the selector switch from one state to another (Step 61); generating a first signal response to the movement of the selector switch (Step 62); processing the first signal (Step 63); transmitting a second signal to an accessory (Step 64); and activating the accessory in response to the transmitted second signal (Step 65). It will be understood that similar method steps may be employed to deactivate the accessory. It will also be understood that other intermediate steps may be included, such as storing information in a memory based on the processed signal, powering up the selector switch, powering down the selector switch, activating the weapon, and the like.

Particular embodiments of the present invention may include additional uses of the weapon control device. For example, and not as a limitation, the selector switch can be used in conjunction with stored power supplies anywhere on a weapon, or an operator, or transmitted through each in order to perform energy based actions, such as a charging batteries stored in a weapons buttstock or operators pack that are used for other accessories attached to the batteries.

It will be understood that there are many various uses for the signal that is generated and captured by the CPU or processor. These additional uses include:

1. The signal transmitted by the selector switch may also activate accessories or peripherals carried by the operator or within range of the transmitted signal. Therefore headlamps, night vision goggles or any other receiver or transceiver outfitted devices may be activated at the time a weapon is placed in a fire state with the selector switch.

2. An armed guard could wire searchlights or spotlights with transceiver to activate lights when the weapon is armed. Rooms could be programmed to turn lights on or off as an operator or guard passes trough areas within the transmitters range giving him tactical advantage and the element of surprise. Theoretically any electronic device could be activated by the transmission of the signal generated by the selector switch if the electronic device includes a receiver to receive and react to such a signal.

3. Optimal combat conditions could be created in military areas of concern regarding lighting and visibility as well as manipulation of surrounding air quality with chemical agents, tear gas, irritants, smoke or some other deterrent dispensing system pre wired to deploy the defensive measures at the detection of this inventions transmitted signal giving the tactical advantage to an operator upon the activation of his weapon.

4. Signals could be relayed to radios or other large scale transmitters as to the status of the weapon and that data can be relayed to a separate monitoring party. This communication system can be simplex or duplex meaning the selector switch can transmit only (simplex communication method) or it can transmit and receive information or data (duplex).

5. The firearm may be used like a panic button setting off alarms fitted with receivers or transceivers regardless if deadly force is a necessary option.

6. The firearms selector switch may take on the roll of a detonator for pre set explosives wired with receivers.

7. The transmitters activation may be used to close automatic gates or activate other structural defensive measures like tire spikes, blast shields, or roadblocks. In the time it takes for a soldier to become aware of a threat to the time it would otherwise take to activate such measures separately, lives may be lost.

8. The transmitter or transceiver may also relay information regarding the activation of the accessories to an outside devise such as a satellite transmitter and in military applications, observers would be able to alert users in the field through radio communication that their accessories are on and consuming battery power in the event that the users in the field are unaware of their weapons status. This reserves power for tactical operations in which the accessories are vital, necessary or important to the success of the operation and the safety of the user.

Figure 9:
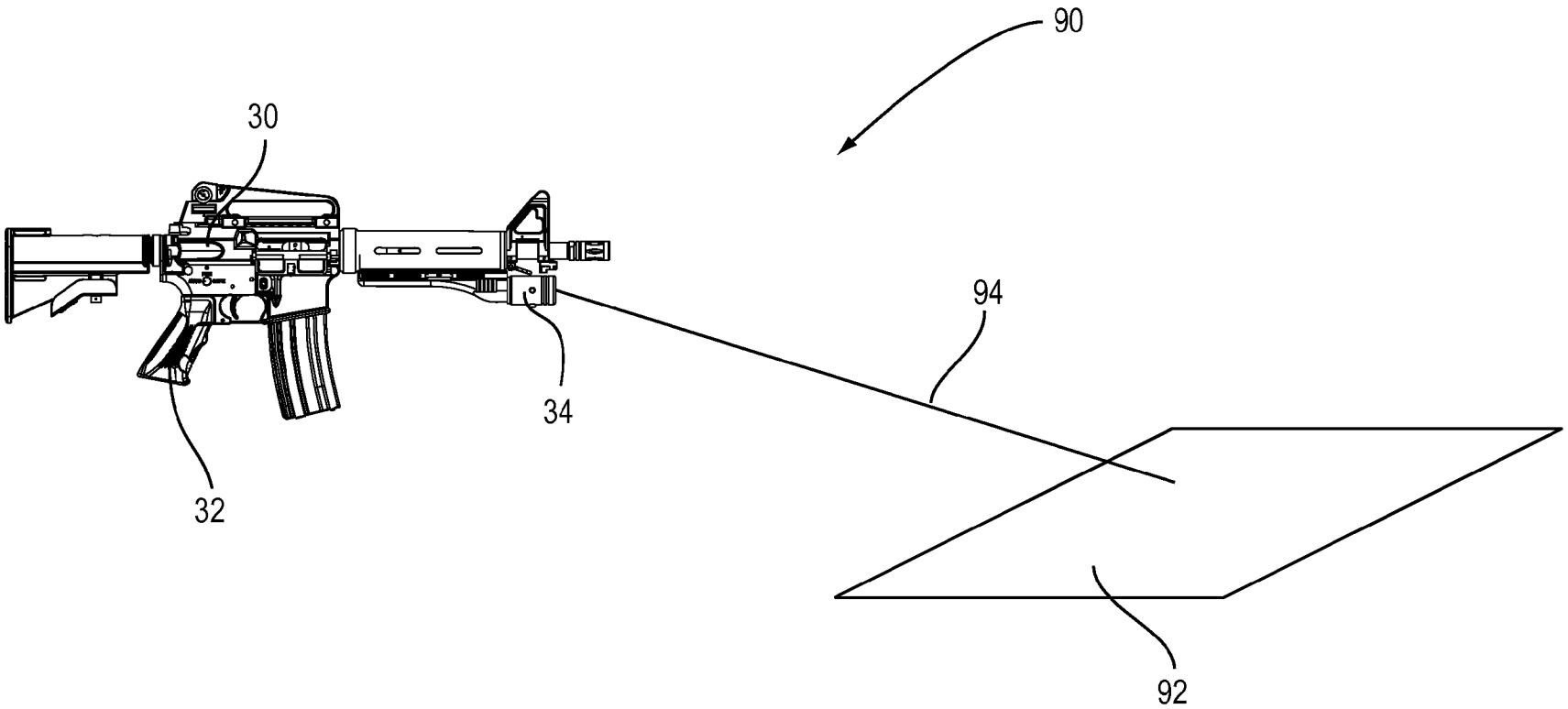
FIG. 9 is a perspective view of a weapon used in a particular embodiment limiting the direction of firing the weapon.

Another embodiment of the present invention includes weapon firing system 90 shown in FIG. 9. The firing system 90 includes a weapon 30 having a pistol grip 32 with a weapon control device within the pistol grip (not shown). The weapon 30 may further include a laser sight 34. Further, the firing system comprises a predetermined area 92. When a laser 94 is directed from the laser sight 34 to the predetermined area 92, the weapon 30 may be activated and fire in response to a communication received by a transceiver integral with the weapon control device. Further, the weapon control device disables the weapon 30 in response to movement of the laser 94 outside of the predetermined area 92. This may be used in certain environments, such as training environments and shooting ranges. It allows the weapon to only fire in a predetermined direction.

It should be understood that the designed intent of the multipurpose selector switch is to allow its operator many tactical advantages. In military or police applications it answers the requirements for the operator who wishes to keep his or her location or presence hidden until the point at which the weapon is armed and prepared for combat. The present invention may activate any accessories on the operator's weapon system that would otherwise need to be activated or turned on individually by the operator costing additional time in a potentially hostile environment during which time the operator might be receiving incoming gunfire. Crowd control or defensive measures could be prepared around an area of concern and activated in collaboration with a selector switch on a weapon.

Sensors and components of many types can be incorporated in the invention such as temperature gauges, global positioning systems (G.P.S.), pressure gauges, health monitoring equipment, gyros, or motion sensors, moisture detectors, audio microphones, radiation sensors or detection equipment for radiation, biological, or chemical agents. The inventions signal could be linked to a satellite communications network allowing supervisors to see data from a soldiers weapon to help improve situation awareness on a battlefield. Sensors may also be used to detect how many rounds a weapon has fired since it's last cleaning. The same data could tell an armorer when to replace certain perishable parts, such as gas rings, springs, or other components that wear over time.

Civilian uses of the present invention may include other accessories to those discussed above. For example, and without limitation, the Weapon control device may activate functions such as automatically closing and locking doors, activate smoke generators, trigger a household alarm system or many other electronic devices inside a residence which could be activated in response to the selector switch being moved to a fire position. This would help to identify persons by providing additional light and may further help to prevent innocent people from being accidentally injured due to possible misidentification. Electronics could also be arranged to contact the owner of the weapon on their mobile phone or e-mail and inform them that someone has activated their weapon. In turn a gun owner may text call or dial in a code that may prevent the weapon from firing. This may help a distracted parent secure their weapon before an accident takes place.

The invention can be manufactured to replace a weapons selector switch with an assembly that performs the same function as the original selector switch as to the activation of the weapon system in addition to creating a signal that will be used to activate any accessory outfitted with a transceiver, receiver, or other means of receiving a signal. The signal generated can be used to turn on flashlights, lasers, range finders, or electronic optics of any type without limitation. The activation of the switch informs the accessories or electronics which are outfitted with receivers or transceivers that it is time to activate. The sent data could be without limitation a simple signal such as a single pulse or wave of energy, or it could be many forms of telemetry data, video, audio or any conceivable transmission of data. The particular use for an application of the invention will determine what transmissions and therefore what hardware would be included.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A weapon control device coupled within a weapon for controlling accessories and auxiliary components, the control device comprising:

a processor; and a biased connector operably engaging a fire control selector switch of a weapon, the biased connector having:

a biased co-axial connector;

a connector tip;

a wire electrically coupled on one end to the connector tip and coupled on the other end to an electrical connector for electrically connecting the biased connector to connectivity points which are electrically connected to the processor, wherein the processor receives a signal from the connector in response to movement of the fire control selector switch a transceiver, wherein the transceiver sends a signal in response to the processor receiving a signal from the biased connector; and a weapon accessory, wherein the weapon accessory is activated in response to the signal sent by the transceiver, the weapon accessory selected from the group consisting of flashlights, lasers, range finders and/or electronic optics.

2. The control device of claim 1, wherein the transceiver is placed into a listening status in response to the processor receiving a signal from the biased connector.

3. The control device of claim 1, wherein the biased connector sends a signal in response to the fire control selector switch moving from a safe status to a fire status.

4. A weapon control device coupled within a pistol grip of a weapon for controlling accessories and auxiliary components, the control device comprising:

a removable housing repeatably removable from within a pistol grip of a weapon, the housing retaining:

a processor;

at least one connection point electrically coupled to the processor; and a slideable biased securing device, wherein the securing device releasably secures to the housing within the pistol grip in response to the securing device being biased to engage a recess of the pistol grip;

a biased connector operably engaging a fire control selector switch of a weapon and electrically engaging the at least one connection point when the housing is secured within the pistol grip, the biased connector having:

a biased co-axial connector;

a connector tip;

a wire electrically coupled on one end to the connector tip and coupled on the other end to an electrical connector for electrically connecting the biased connector to the at least one connection point, wherein the processor receives a signal from the connector in response to movement of the fire control selector switch a transceiver, wherein the transceiver sends a signal in response to the processor receiving a signal from the biased connector; and a weapon accessory, wherein the weapon accessory is activated in response to the signal sent by the transceiver, the weapon accessory selected from the group consisting of flashlights, lasers, range finders and/or electronic optics.

5. The control device of claim 4, wherein the transceiver is placed into a listening status in response to the processor receiving a signal from the biased connector.

6. The control device of claim 4, wherein the fire control selector switch is moveable between multiple weapon statuses, the multiple weapon statuses including at least safe status, fire status, auto status, and burst status.

7. The control device of claim 6, wherein the signal received by the processor is sent by the biased connector in response to the fire control selector switch moving from one status to another status.

8. The control device of claim 7, wherein signal sent by the connector is different for each status of the weapon.

9. The control device of claim 8, further comprising a memory storing information relating to predetermined accessories and auxiliary components, wherein the stored information corresponds to a type of signal received by the processor.

10. The control device of claim 9, wherein type of signal sent by the transceiver is determined in response to the type of signal received by the processor.

11. The control device of claim 10, wherein the accessory and auxiliary component corresponding to the stored information in the memory is activated in response to the signal sent by the transceiver.

12. The control device of claim 4, further comprising a disablement device, wherein the disablement device is operatively coupled to a trigger of the weapon.

13. The control device of claim 12, wherein the disablement device comprises an actuator, an actuator arm and a disablement shaft coupled to the trigger, the disablement shaft having a notch.

14. The control device of claim 13, wherein the actuator arm repeatably engages and disengages the notch in response to respective activation and deactivation of the actuator.

15. The control device of claim 14, wherein the trigger is disabled and enable in response to the actuator arm respectively engaging and disengaging the notch of the disablement shaft.

* * * * *